US009057379B2

(12) United States Patent
Otsuki et al.

(10) Patent No.: US 9,057,379 B2
(45) Date of Patent: Jun. 16, 2015

(54) CENTRIFUGAL FAN AND METHOD FOR MANUFACTURING THE SAME

(75) Inventors: Takaya Otsuki, Kyoto (JP); Toshikazu Fukunaga, Kyoto (JP)

(73) Assignee: Nidec Corporation, Kyoto (JP)

( * ) Notice: Subject to any disclaimer, the term of this patent is extended or adjusted under 35 U.S.C. 154(b) by 1030 days.

(21) Appl. No.: 13/164,792

(22) Filed: Jun. 21, 2011

(65) Prior Publication Data

US 2012/0156022 A1 Jun. 21, 2012

Related U.S. Application Data

(60) Provisional application No. 61/360,023, filed on Jun. 30, 2010.

(30) Foreign Application Priority Data

Dec. 14, 2010 (JP) ..... 2010-278291

(51) Int. Cl.
*F04D 17/16* (2006.01)
*F04D 29/02* (2006.01)
*F04D 25/06* (2006.01)

(52) U.S. Cl.
CPC ..... *F04D 29/023* (2013.01); *Y10T 29/49243* (2015.01); *F04D 17/16* (2013.01); *F04D 25/0613* (2013.01)

(58) Field of Classification Search
CPC . F05B 2230/90; F05B 2260/95; F04D 29/005
USPC ..... 415/182.1, 200, 203, 204, 206, 215.1, 415/219.1, 220, 224, 224.5, 232
See application file for complete search history.

(56) References Cited

U.S. PATENT DOCUMENTS

| | | | | |
|---|---|---|---|---|
| 5,984,222 | A | 11/1999 | Sasaki | |
| 2005/0265834 | A1* | 12/2005 | Wang et al. | 415/220 |
| 2006/0165525 | A1 | 7/2006 | Kuo et al. | |
| 2007/0166156 | A1* | 7/2007 | Li | 415/220 |
| 2008/0130226 | A1* | 6/2008 | Yamashita et al. | 361/695 |
| 2009/0230798 | A1 | 9/2009 | Ho | |

FOREIGN PATENT DOCUMENTS

| | | | |
|---|---|---|---|
| CN | 101446294 | A | 6/2009 |
| EP | 2 103 843 | A1 | 9/2009 |
| JP | 9-113638 | A | 5/1997 |
| JP | 2006-207578 | A | 8/2006 |
| JP | 2008-157332 | A | 7/2008 |

* cited by examiner

*Primary Examiner* — Edward Look
*Assistant Examiner* — Christopher J Hargitt
(74) *Attorney, Agent, or Firm* — Keating & Bennett, LLP

(57) ABSTRACT

A blower fan includes an impeller centered on a central axis, a motor portion arranged to rotate the impeller about the central axis, and a housing arranged to accommodate the impeller. The housing includes a lower plate portion arranged to cover a lower side of the impeller and a side wall portion arranged to cover a side of the impeller. The lower plate portion is preferably made of, for example, a steel sheet. The side wall portion is preferably made of, for example, a resin. A lower end portion of the side wall portion and an edge portion of the lower plate portion are preferably joined to each other through insert molding. An outer circumferential cut surface of the lower plate portion is arranged in contact with the side wall portion at a joint between the lower end portion of the side wall portion and the edge portion of the lower plate portion.

11 Claims, 8 Drawing Sheets

CENTRIFUGAL FAN AND METHOD FOR MANUFACTURING THE SAME

BACKGROUND OF THE INVENTION

1. Field of the Invention

The present invention relates to a blower fan and a method of manufacturing the blower fan.

2. Description of the Related Art

FIG. 2A of JP-A 2006-207578 discloses a horizontal blower 100. Paragraph [0010] of JP-A 2006-207578 states that the horizontal blower 100 is made up of a housing 102 and an impeller 108. Paragraph [0012] of JP-A 2006-207578 states that the housing 102 is made up of outer frames 102a and 102b joined to each other, and that the outer frames 102a and 102b can be joined to each other through, for example, coupling, riveting, locking, adhesion, or the like.

FIG. 4 of US 2009/0230798 discloses a fan motor 1, a plate member 2, a coupling barrel 3, and an outer case 4. Paragraph [0019] of US 2009/0230798 states that the plate member 2 is made of metal, and that the coupling barrel 3 and the outer case 4 are made of plastic. According to paragraphs [0020] and [0021] of US 2009/0230798, the coupling barrel 3, to which the fan motor 1 is attached, is coupled to a through-hole 23 of the plate member 2 through insert molding. In addition, the plate member 2 includes a plurality of positioning legs 24 arranged to extend obliquely from a periphery of the through-hole 23. The positioning legs 24 are embedded in the coupling barrel 3. According to paragraph [0022] of US 2009/0230798, the outer case 4 includes a case body 41 and a cover body 42. The cover body 42 is arranged to extend from the case body 41 to cover a side of the plate member 2 opposite to a side thereof which faces the fan motor 1.

Achieving a reduced thickness of a blower fan as described in US 2009/0230798 is not easy to perform because the cover body 42 of the outer case 4 is arranged below the plate member 2 in an overlapping manner. This being the case, regarding the blower fan of US 2009/0230798, it is only conceivable to join an edge portion of a lower plate portion, to which a motor portion is fixed, to a lower end portion of a side wall portion of a housing through insert molding. In this case, it is necessary to ensure sufficient joint strength between the lower plate portion and the side wall portion to prevent removal of the lower plate portion from the side wall portion.

Here, the blower fan is used, for example, to cool an interior of a case of a notebook personal computer (hereinafter referred to as a "notebook PC"). Regarding the notebook PC, there is a desire to avoid arranging the blower fan such that the blower fan visually stands out when the interior of the case, which is colored black, for example, is viewed through an air inlet defined in the case. It is therefore necessary that a lower surface of the lower plate portion of the blower fan should be colored black. In the case where the lower plate portion is colored black through electrodeposition coating, an outer circumferential surface of the lower plate portion is also coated with a smooth coat of paint, and therefore, only a limited increase in the joint strength between the lower plate portion and the side wall portion can be achieved because of the need to apply paint through, for example, an electrodeposition coating.

SUMMARY OF THE INVENTION

A preferred embodiment of the present invention provides a blower fan which includes an impeller centered on a central axis extending in a vertical direction, a motor portion arranged to rotate the impeller about the central axis, and a housing arranged to accommodate the impeller. The housing preferably includes an upper plate portion arranged to cover an upper side of the impeller; a lower plate portion arranged to cover a lower side of the impeller, and having the motor portion fixed thereto; and a side wall portion arranged to cover a side of the impeller, and to define an air outlet in combination with the upper plate portion and the lower plate portion. At least one of the upper plate portion and the lower plate portion preferably includes an air inlet defined therein. The lower plate portion is preferably defined by, for example, a steel sheet which includes a lower surface that is coated with paint beforehand and which is then subjected to, for example, a press forming process and a stamping process. The lower plate portion will then include an outer circumferential cut surface as a result of the stamping process. The side wall portion is preferably made of, for example, a resin. A lower end portion of the side wall portion and an edge portion of the lower plate portion are joined to each other through, for example, insert molding, with the outer circumferential cut surface of the lower plate portion arranged in contact with the side wall portion at a joint located between the lower end portion of the side wall portion and the edge portion of the lower plate portion.

A blower fan according to preferred embodiments of the present invention is able to achieve an increase in joint strength between the lower plate portion and the side wall portion of the housing.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
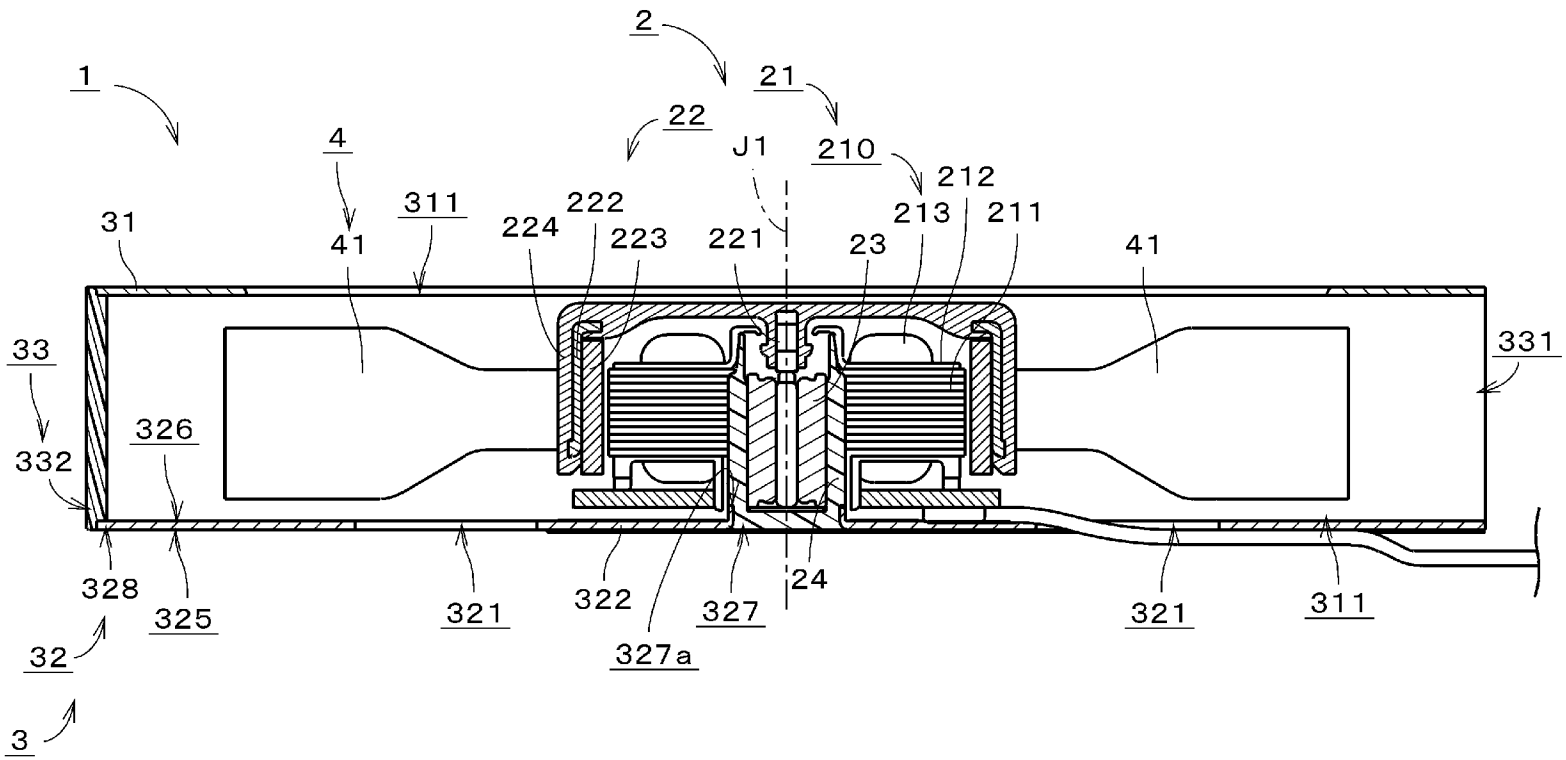
FIG. 1 is a cross-sectional view of a blower fan according to a preferred embodiment of the present invention.

Hereinafter, preferred embodiments of the present invention will be described in detail with reference to the accompanying drawings. It is assumed herein that an upper side and a lower side in a direction parallel or substantially parallel to a central axis of a blower fan illustrated in FIG. 1 are referred to simply as an "upper side" and a "lower side", respectively. Note that a vertical direction assumed herein may not necessarily correspond with a vertical direction of the blower fan when actually installed in a device. It is also assumed herein that a circumferential direction about the central axis is referred to simply as a "circumferential direction", and that a radial direction centered on the central axis is referred to simply as a "radial direction".

FIG. 1 is a cross-sectional view of a blower fan 1 according to a preferred embodiment of the present invention. The blower fan 1 is a centrifugal fan, and is installed in, for example, a notebook personal computer (hereinafter referred to as a "notebook PC. The blower fan 1 is arranged to cool devices inside a case of the notebook PC.

The blower fan 1 includes a motor portion 2, a housing 3, and an impeller 4. The impeller 4 is centered on a central axis J1 extending in the vertical direction. The motor portion 2 is arranged to rotate the impeller 4 about the central axis J1. The housing 3 is arranged to accommodate the motor portion 2 and the impeller 4.

The housing 3 preferably includes an upper plate portion 31, a lower plate portion 32, and a side wall portion 33. The upper plate portion 31 is arranged to cover an upper side of the impeller 4 in FIG. 1. The lower plate portion 32 is arranged to cover a lower side of the impeller 4. The motor portion 2 is fixed to the lower plate portion 32. The side wall portion 33 is arranged to cover a side of the impeller 4. The side wall portion 33 is arranged to define an air outlet 331 in combination with the upper plate portion 31 and the lower plate portion 32.

Both the upper plate portion 31 and the lower plate portion 32 are preferably made of, for example, a metal. The side wall portion 33 is preferably made of, for example, a resin. A lower end portion 332 of the side wall portion 33 and an edge portion 328 of the lower plate portion 32 are preferably joined to each other through, for example, insert molding. The edge portion 328 of the lower plate portion 32 refers to a portion in the vicinity of an outer circumference of the lower plate portion 32. The upper plate portion 31 is fixed to an upper end portion of the side wall portion 33 through, for example, screwing or the like. A lower surface 325 of the lower plate portion 32 is colored black through, for example, a coat of paint, so that the blower fan 1 is prevented from visually standing out when an interior of the case of the notebook PC, which is colored black, is viewed through an air inlet defined in the case. An upper surface 326 of the lower plate portion 32 is preferably not provided with a coat of paint. Note that the color of the coat is not limited to black in other preferred embodiments of the present invention and can instead be any other desirable color.

Figure 2:
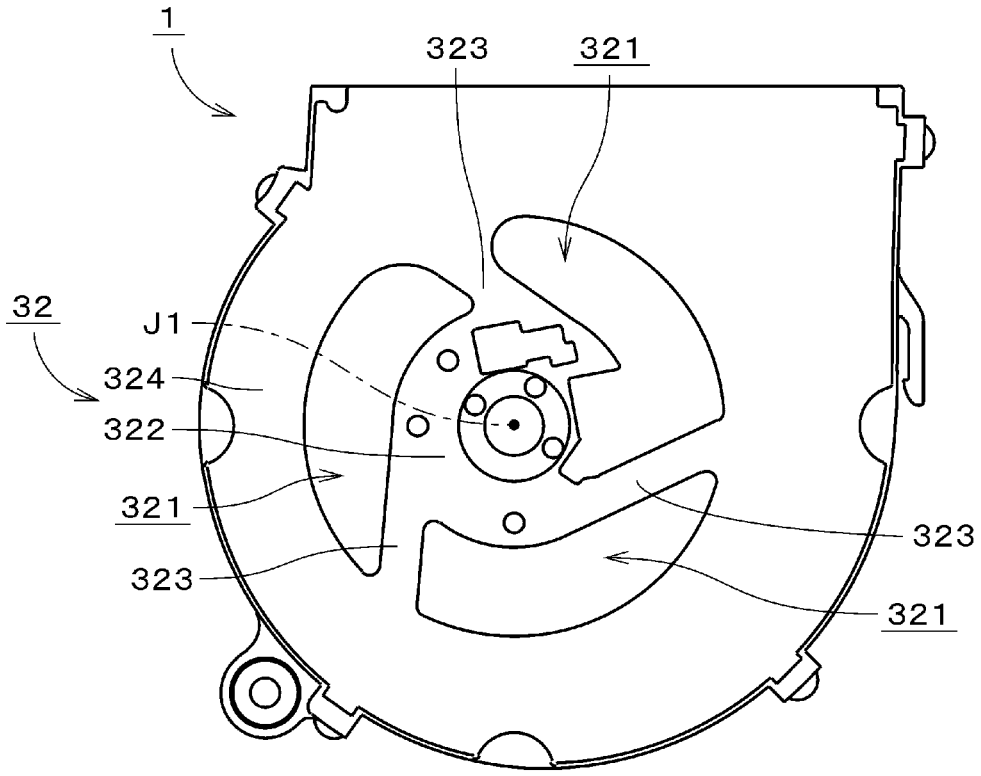
FIG. 2 is a bottom view of the blower fan.

FIG. 2 is a bottom view of the blower fan 1. The impeller 4 is not shown in FIG. 2. Referring to FIGS. 1 and 2, the lower plate portion 32 preferably includes three air inlets 321 arranged opposite the impeller 4. In addition, referring to FIG. 1, the upper plate portion 31 preferably includes one air inlet 311 arranged opposite the impeller 4. Hereinafter, the air inlet 311 and the air inlets 321 will be referred to as an "upper air inlet 311" and "lower air inlets 321", respectively. The upper air inlet 311 is provided substantially in the shape of a circle and centered on the central axis J1.

Referring to FIG. 2, the lower plate portion 32 preferably includes a motor fixing portion 322, a plurality of ribs 323, and an outer portion 324. The motor portion 2 is fixed to the motor fixing portion 322. The outer portion 324 is arranged to surround the motor fixing portion 322. The ribs 323 are arranged to join the motor fixing portion 322 and the outer portion 324 to each other. In the present preferred embodiment, the number of ribs 323 is preferably three.

The three ribs 323 are arranged between the three lower air inlets 321, which are arranged in the circumferential direction to substantially surround an outer circumference of the motor fixing portion 322. In other words, each of the three lower air inlets 321 is defined between the motor fixing portion 322, the outer portion 324, and a pair of adjacent ones of the ribs 323.

As illustrated in FIG. 1, the motor portion 2 is preferably an outer-rotor type, for example. The motor portion 2 includes a stationary portion 21, which is a stationary assembly, a rotating portion 22, which is a rotating assembly, and a sleeve 23, which is arranged as a bearing. The sleeve 23 preferably is substantially in the shape of a cylinder and centered on the central axis J1. The rotating portion 22 is supported through the sleeve 23 to be rotatable about the central axis J1 with respect to the stationary portion 21.

The stationary portion 21 preferably includes a stator 210 and a bearing support portion 24. The bearing support portion 24 is arranged to accommodate the sleeve 23. The bearing support portion 24 is substantially in the shape of a cylinder and centered on the central axis J1, and is preferably made of, for example, a resin. The bearing support portion 24 is arranged to project upward from the motor fixing portion 322 of the lower plate portion 32. The bearing support portion 24 is fixed to a hole portion 327 defined in the motor fixing portion 322. A lower end portion of the bearing support portion 24 and a portion surrounding the hole portion 327 of the motor fixing portion 322 are joined to each other preferably through insert molding, for example.

The stator 210 is provided with an annular shape and arranged to be centered on the central axis J1, and is attached to an outside surface of the bearing support portion 24. The stator 210 preferably includes a stator core 211, an insulator 212, and coils 213. The stator core 211 is preferably defined by laminated silicon steel sheets each of which is in the shape of a thin plate, although any other desirable type of stator core could be used instead. The insulator 212 is arranged to cover a surface of the stator core 211.

The rotating portion 22 includes a shaft 221, a yoke 222, a rotor magnet 223, and a cup 224. The cup 224 preferably is substantially in the shape of a covered cylinder and centered on the central axis J1, and includes a downward opening. The shaft 221 is arranged to have the central axis J1 at its center, and an upper end portion of the shaft 221 is fixed to the cup 224. The yoke 222 is substantially in the shape of a cylinder and centered on the central axis J1, and is fixed to an inside surface of the cup 224. The rotor magnet 223 preferably is substantially in the shape of a cylinder and centered on the central axis J1, and is fixed to an inside surface of the yoke 222.

The shaft 221 is inserted inside the sleeve 23. The sleeve 23 is preferably made of an oil-bearing porous metal, for example. The sleeve 23 is inserted in and fixed to the bearing support portion 24. Note that a ball bearing, for example, may be used as a bearing mechanism in other preferred embodiments of the present invention.

The impeller 4 includes a plurality of blades 41. The blades 41 are preferably arranged to have an annular shaped arrangement around the outside of the cup 224, and centered on the central axis J1. A radially inner end portion of each blade 41 is fixed to an outside surface of the cup 224. A current is supplied to the stationary portion 21 to produce a torque centered on the central axis J1 between the rotor magnet 223 and the stator 210. The impeller 4 is thereby arranged to rotate about the central axis J1 together with the rotating portion 22 in response to the torque produced between the rotor magnet 223 and the stator 210. The rotation of the impeller 4 causes air to be introduced into the housing 3 through the upper air inlet 311 and the lower air inlets 321, and sent out through the air outlet 331.

Figure 3:
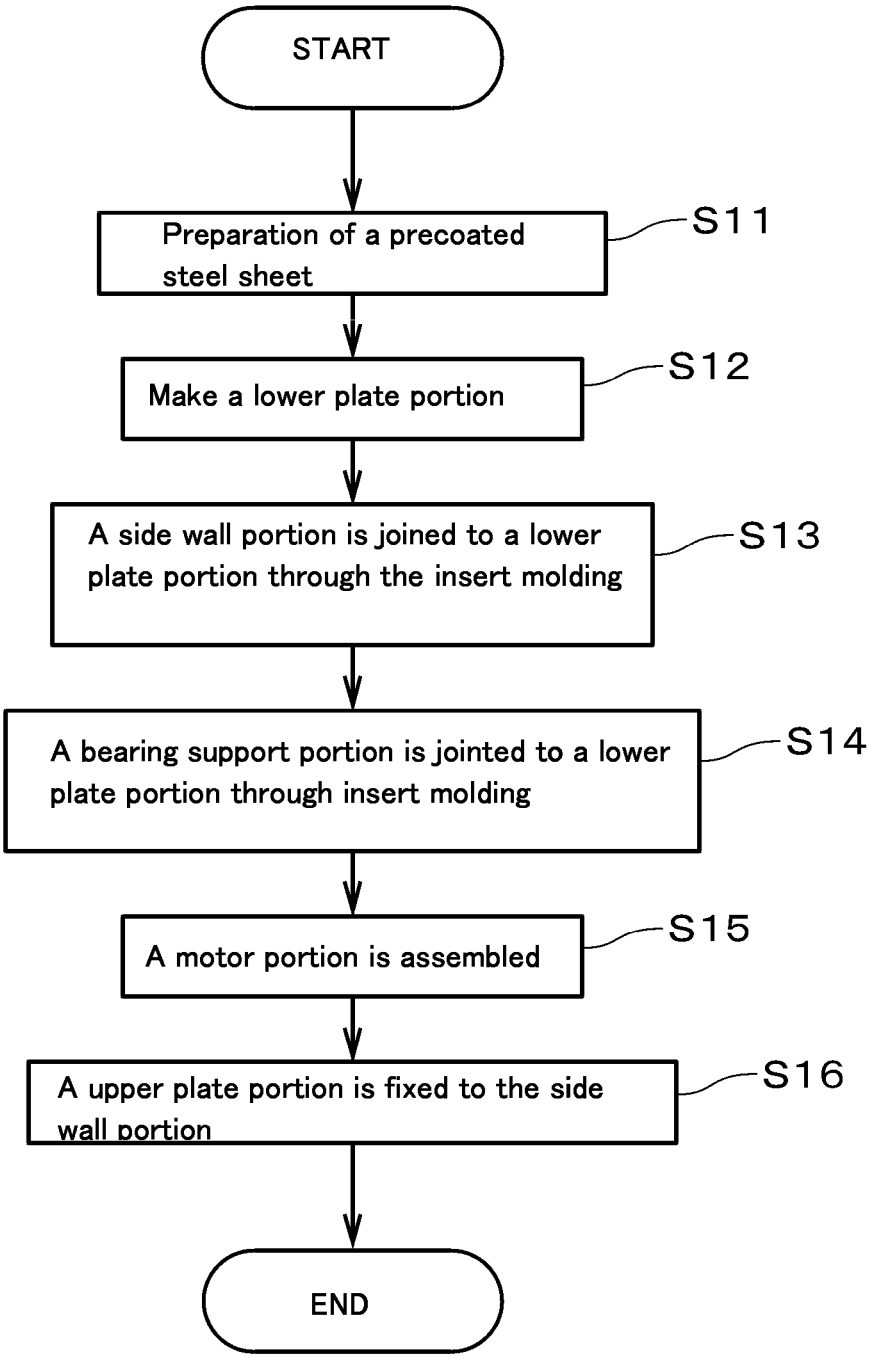
FIG. 3 is a flowchart illustrating a flow of production of the blower fan.
Figure 4:
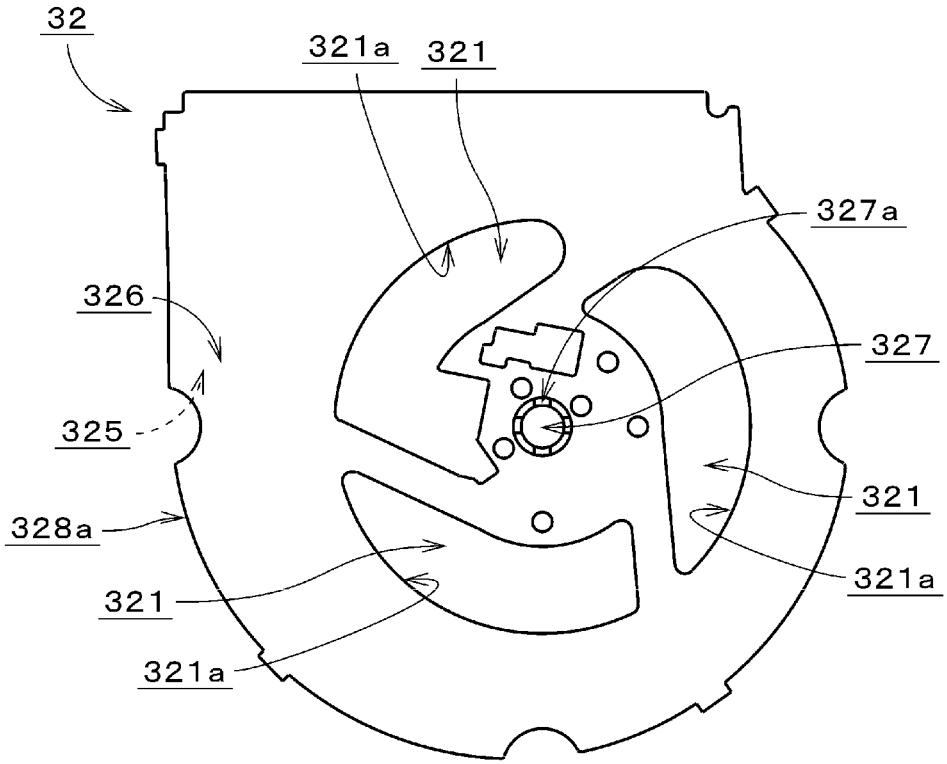
FIG. 4 is a plan view of a lower plate portion according to a preferred embodiment of the present invention.
Figure 5:
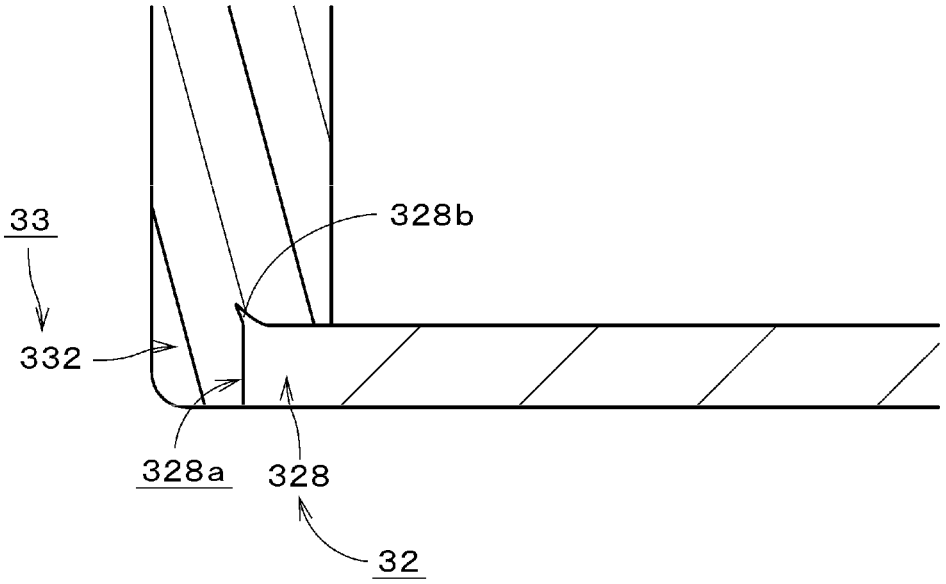
FIG. 5 is a cross-sectional view illustrating a portion where a side wall portion and the lower plate portion are joined to each other and its vicinity, according to a preferred embodiment of the present invention.

Next, a method of manufacturing the blower fan 1 will now be described below. FIG. 3 is a flowchart illustrating a flow of production of the blower fan 1. FIG. 4 is a plan view of the lower plate portion 32. FIG. 5 is a cross-sectional view illustrating, in an enlarged form, a portion where the side wall portion 33 and the lower plate portion 32 are joined to each other and its vicinity.

In the production of the blower fan 1, at first, a flat precoated steel sheet whose lower surface is coated with a black paint beforehand is prepared (step S11). An upper surface of the precoated steel sheet is preferably not provided with a coat of paint. Note that the upper surface of the precoated steel sheet may be provided with a coat of paint in other preferred embodiments of the present invention. Next, the precoated steel sheet is subjected to, for example, a press forming process and a stamping process to define the lower plate portion 32 of the housing 3 as illustrated in FIG. 4 (step S12). The upper surface and the lower surface of the precoated steel sheet define the upper surface 326 and the lower surface 325 of the lower plate portion 32, respectively.

When the stamping process is performed at step S12, an outer circumferential cut surface 328*a* is formed at a side surface of the lower plate portion 32. In addition, the lower air inlets 321 and an inner circumferential cut surface 321*a* of each of the lower air inlets 321, and the hole portion 327 and a cut surface 327*a* of the hole portion 327 are also formed at this time. The portion surrounding the hole portion 327 is deformed to project upward as a result of the press forming process, with the result that the cut surface 327*a* faces upward.

Referring to FIG. 5, after step S12, the lower end portion 332 of the side wall portion 33 is joined to the edge portion 328 of the lower plate portion 32 through the insert molding (step S13). The edge portion 328 of the lower plate portion 32 refers to a portion of the lower plate portion 32 which includes the outer circumferential cut surface 328*a* and its vicinity. At a joint between the side wall portion 33 and the lower plate portion 32, the outer circumferential cut surface 328*a* of the lower plate portion 32 is arranged in contact with the lower end portion 332 of the side wall portion 33.

Assume, for example, a steel sheet is subjected to press forming process and a stamping process, and that the resulting steel sheet is subjected to electrodeposition coating or the like to define the lower plate portion. In this case, an outer circumferential surface of the lower plate portion will be a smooth surface with a coat of paint. In contrast, the outer circumferential cut surface 328*a* of the lower plate portion 32 of the blower fan 1 is an uncoated cut surface resulting from the stamping process, as described above. The outer circumferential cut surface 328*a* is therefore rougher than the outer circumferential surface with the coat of paint. This contributes to an increase in the joint strength between the lower plate portion 32 and the side wall portion 33, which in turn contributes to an improvement in strength of the housing 3.

As a result of the stamping process performed at step S12, an upward facing burr 328*b* is defined at the outer circumferential cut surface 328*a* of the lower plate portion 32. The burr 328*b* is arranged inside the lower end portion 332 of the side wall portion 33 and in contact with the side wall portion 33. This burr 328*b* and its arrangement inside the lower end portion 332 of the side wall portion 33 contributes to an additional increase in the joint strength between the lower plate portion 32 and the side wall portion 33.

At the joint between the side wall portion 33 and the lower plate portion 32, the lower end portion 332 of the side wall portion 33 is also arranged in contact with an upper surface of the edge portion 328 of the lower plate portion 32. This makes it easier to determine the position of the lower plate portion 32 relative to the side wall portion 33 during the insert molding at step S13. The insert molding is thus easily accomplished.

Figure 6:
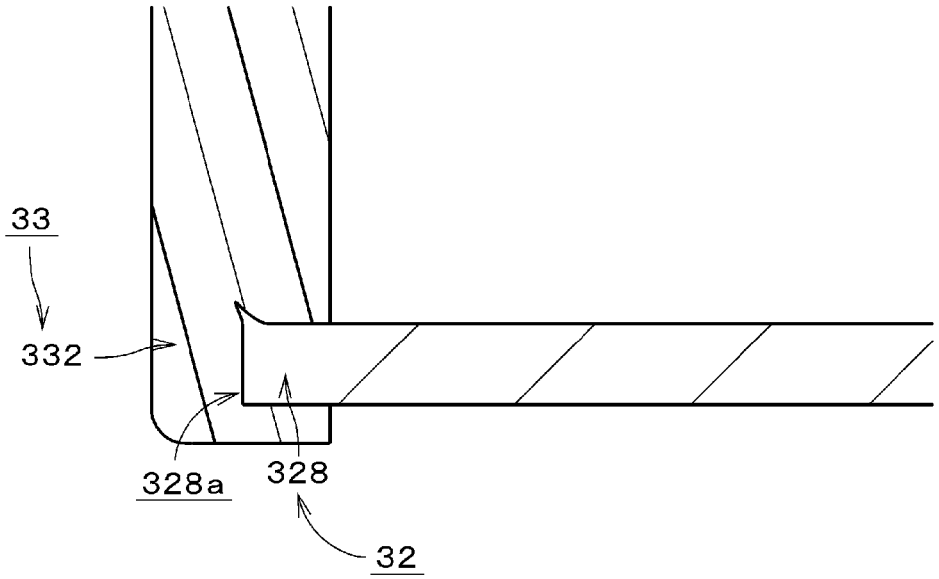
FIG. 6 is a cross-sectional view illustrating a joint between a side wall portion and a lower plate portion according to another preferred embodiment of the present invention.

FIG. 6 is an enlarged cross-sectional view illustrating the joint between the side wall portion 33 and the lower plate portion 32 according to another preferred embodiment of the present invention. In FIG. 6, the lower end portion 332 of the side wall portion 33 is arranged in contact with the upper surface and a lower surface of the edge portion 328 as well as with the outer circumferential cut surface 328*a* of the lower plate portion 32. In other words, the edge portion 328 of the lower plate portion 32 is held by the lower end portion 332 of the side wall portion 33 from both above and below. This contributes to an additional increase in the joint strength between the lower plate portion 32 and the side wall portion 33.

Referring to FIG. 1, the bearing support portion 24 and the portion surrounding the hole portion 327 of the lower plate portion 32 are joined to each other through insert molding (step S14). Although not accurately shown in FIG. 3, steps S13 and S14 are performed simultaneously during the production of the blower fan 1. At a joint between the bearing support portion 24 and the lower plate portion 32, the cut surface 327*a* of the hole portion 327 is arranged in contact with the bearing support portion 24. Similarly to the outer circumferential cut surface 328*a*, the cut surface 327*a* is preferably a rough surface without a coat of paint. This arrangement contributes to an increase in joint strength between the bearing support portion 24 and the lower plate portion 32. Note that step S14 may be performed before step S13 or after step S13 is completed, in other preferred embodiments of the present invention.

Figure 7:
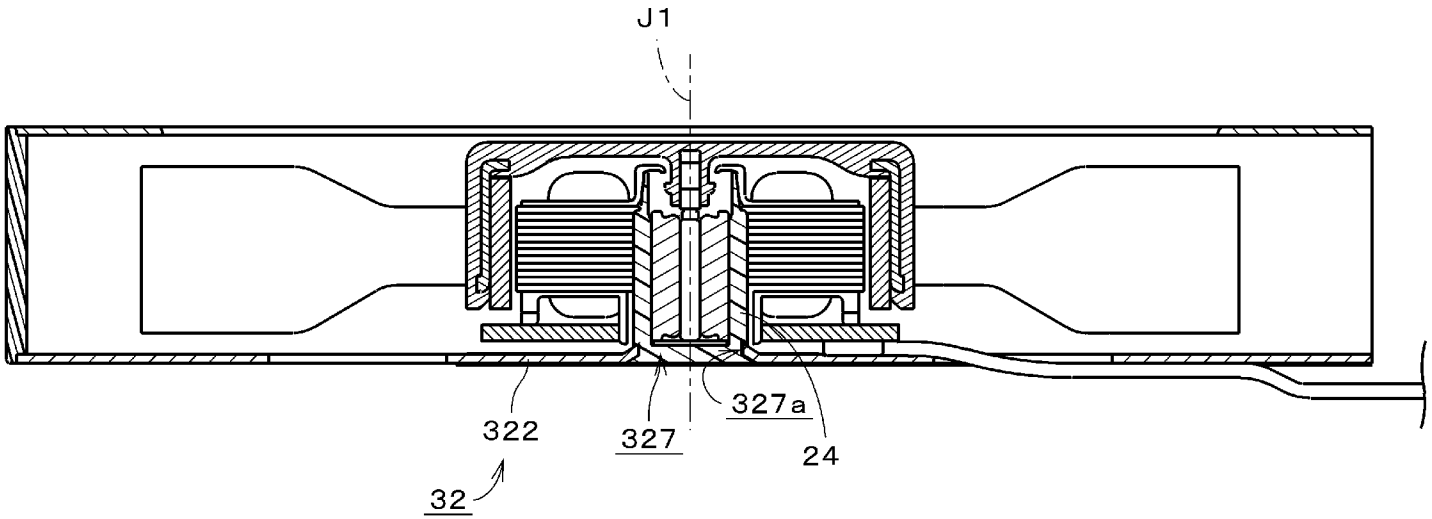
FIG. 7 is a cross-sectional view illustrating a joint between a bearing support portion and a lower plate portion according to yet another preferred embodiment of the present invention.

FIG. 7 is a cross-sectional view illustrating a joint between the bearing support portion 24 and the lower plate portion 32 according to another preferred embodiment of the present invention. In FIG. 7, the portion surrounding the hole portion 327 of the lower plate portion 32 is arranged to project upward obliquely with respect to the central axis J1, with the cut surface 327*a* facing radially inward. In comparison to the structure illustrated in FIG. 1, the structure illustrated in FIG. 7 is able to achieve an increase in the joint strength between the bearing support portion 24 and the lower plate portion 32 owing to the rough cut surface 327*a*.

After step S14 is completed, the stator 210 illustrated in FIG. 1 is fixed to the outside surface of the bearing support portion 24. The sleeve 23 is inserted in and fixed to the bearing support portion 24. In addition, the shaft 221 is inserted in the sleeve 23. The rotating portion 22 is thereby attached to the lower plate portion 32 together with the impeller 4 fixed to the cup 224 (step S15). The motor portion 2 is assembled above the lower plate portion 32 through steps S14 and S15.

The upper plate portion 31 is thereafter fixed to the upper end portion of the side wall portion 33 to define the housing 3 having the air outlet 331 on its side (step S16). A lower boundary of the air outlet 331 is defined by a portion of the outer circumferential cut surface 328*a* of the lower plate portion 32. In other words, a portion of the outer circumferential cut surface 328*a* of the lower plate portion 32 is exposed below the air outlet 331. This portion of the outer circumferential cut surface 328*a* will be hereinafter referred to as an "exposed portion". In the present preferred embodiment, the exposed portion of the outer circumferential cut surface 328*a* is preferably not provided with a coat of paint. Note that the exposed portion of the outer circumferential cut surface 328*a* may be colored black through, for example, an oil-based ink or the like in other preferred embodiments of the present invention.

Figure 8:
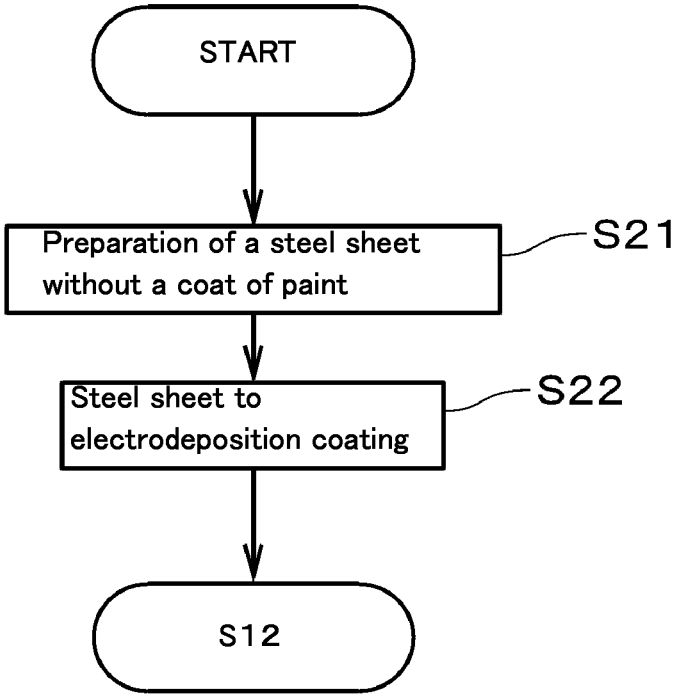
FIG. 8 is a flowchart illustrating a flow of production of a blower fan according to yet another preferred embodiment of the present invention.

FIG. 8 is a flowchart illustrating a flow of the production of the blower fan 1 according to another preferred embodiment of the present invention. FIG. 8 illustrates only a portion of the flow of the entire production process. In the production of the blower fan 1 illustrated in FIG. 8, a step of preparing, for example, a steel sheet without a coat of paint (i.e., step S21) and a step of subjecting the steel sheet to electrodeposition coating (i.e., step S22) are performed in place of step S11 in FIG. 3. In step S22, one side of the steel sheet, which is flat or substantially flat, is coated with, for example, a black paint through the electrodeposition coating. Steps S12 to S16 illustrated in FIG. 3 are performed thereafter to define the housing 3. The side of the steel sheet which has been coated with the paint at step S22 defines the lower surface 325 of the lower plate portion 32 of the housing 3.

While preferred embodiments of the present invention have been described above, the present invention is not limited to the above-described preferred embodiments, but a variety of modifications are possible.

For instance, the blower fan 1 may be installed inside a case of a notebook PC with the upper plate portion 31 of the blower fan 1 being visible from outside the notebook PC. In this case, the upper plate portion 31 needs to be colored and thus the upper plate portion 31 may also be defined by, for example, subjecting a precoated steel sheet whose principal surface corresponding to the upper surface of the upper plate portion 31 is coated with a paint beforehand to, for example, a press forming process and a stamping process. Alternatively, a steel sheet without a coat of paint may be subjected first to electrodeposition coating or the like and thereafter to press forming process and a stamping process to define the upper plate portion 31 with the upper surface thereof coated with paint. Only the upper plate portion 31 may be made from a precoated steel sheet to have the upper surface coated with paint, depending on the arrangement of the blower fan 1 inside the case of the notebook PC and on the structure of the housing 3.

Although the upper air inlet 311 and the lower air inlets 321 are preferably provided in the housing 3 of the blower fan 1 according to the above-described preferred embodiments, only either the upper air inlet 311 or the lower air inlet(s) 321 may be provided in other preferred embodiments of the present invention, depending on the purpose of the blower fan. In other words, it is enough that at least one of the upper plate portion 31 and the lower plate portion 32 of the housing 3 includes an air inlet defined therein.

Note that features of the above-described preferred embodiments and modifications thereof may be combined appropriately as long as no conflict occurs.

Blower fans according to preferred embodiments of the present invention can be used to cool a device inside a case of a notebook PC or a desktop PC, to cool other devices, to supply air to a variety of objects, and so on. Blower fans according to preferred embodiments of the present invention are also usable for other purposes.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A blower fan comprising:

an impeller centered on a central axis extending in a vertical direction;

a motor portion arranged to rotate the impeller about the central axis; and a housing arranged to accommodate the impeller; wherein the housing includes:

an upper plate portion arranged to cover an upper side of the impeller;

a lower plate portion arranged to cover a lower side of the impeller, and arranged such that the motor portion is fixed thereto; and a side wall portion arranged to cover a side of the impeller, and to define an air outlet in combination with the upper plate portion and the lower plate portion;

at least one of the upper plate portion and the lower plate portion includes an air inlet defined therein;

the lower plate portion is defined by a sheet having a lower surface coated with a paint, the lower plate portion including an outer circumferential cut surface;

the side wall portion is made of a resin;

a lower end portion of the side wall portion and an edge portion of the lower plate portion are directly and integrally joined to each other, with the outer circumferential cut surface of the lower plate portion arranged in contact with the side wall portion at a joint between the lower end portion of the side wall portion and the edge portion of the lower plate portion; and the outer circumferential cut surface of the lower plate portion is fixedly embedded within the side wall portion through insert molding.

2. The blower fan according to claim 1, wherein the outer circumferential cut surface includes an upwardly projecting burr.

3. The blower fan according to claim 1, wherein the lower end portion of the side wall portion is arranged in contact with an upper surface of the edge portion of the lower plate portion.

4. The blower fan according to claim 1, wherein an upper surface of the lower plate portion does not have any paint thereon.

5. The blower fan according to claim 1, wherein a portion of the outer circumferential cut surface of the lower plate portion is arranged to define a lower boundary of the air outlet.

6. The blower fan according to claim 1, wherein the lower plate portion includes the air inlet, the air inlet including an inner circumferential cut surface.

7. The blower fan according to claim 1, wherein the motor portion includes a bearing support portion arranged to project upward from the lower plate portion, and to accommodate a bearing mechanism;

the bearing support portion is made of a resin;

the lower plate portion includes a hole portion defined therein, the hole portion including a cut surface; and the bearing support portion and a portion of the lower plate portion which surrounds the hole portion are directly and integrally joined to each other, with the cut surface of the hole portion arranged in contact with the bearing support portion at a joint between the bearing support portion and the portion of the lower plate portion which surrounds the hole portion.

8. A method of manufacturing a blower fan, the method comprising the steps of:

a) subjecting a sheet having a lower surface coated with a paint beforehand to press forming process and a stamping process to define a lower plate portion;

b) joining a lower end portion of a side wall portion made of a resin to an edge portion of the lower plate portion through insert molding;

c) assembling a motor portion arranged to rotate an impeller about a central axis above the lower plate portion; and d) fixing an upper plate portion to an upper end portion of the side wall portion to define a housing arranged to accommodate the impeller; wherein at least one of the upper plate portion and the lower plate portion includes an air inlet defined therein;

the side wall portion is arranged to define an air outlet in combination with the upper plate portion and the lower plate portion;

the lower plate portion includes an outer circumferential cut surface defined as a result of the stamping process, the outer circumferential cut surface being arranged in contact with the side wall portion at a joint between the lower end portion of the side wall portion and the lower plate portion; and the outer circumferential cut surface of the lower plate portion is fixedly embedded within the side wall portion through insert molding.

9. The method according to claim 8, wherein the lower surface of the steel sheet is coated with the paint through electrodeposition coating before step a).

10. The blower fan according to claim 1, wherein the sheet defining the lower plate portion is made of steel.

11. The method according to claim 8, wherein the sheet is made of steel.

* * * * *